United States Patent [19]

Meeko

[11] Patent Number: 4,487,412

[45] Date of Patent: Dec. 11, 1984

[54] WEIGHT LIFTING GRIPS

[76] Inventor: Joseph J. Meeko, 524 Penn St., N. Catasauqua, Pa. 18032

[21] Appl. No.: 512,229

[22] Filed: Jul. 11, 1983

[51] Int. Cl.[3] ..... A63B 11/00

[52] U.S. Cl. ..... 272/123; 272/143

[58] Field of Search ..... 272/123, 122, 143; 2/16, 17, 161 A; 114/39, 97; 441/69; 273/165, 166; 224/218, 219, 222, 252, 268; 294/25; 16/110

[56] References Cited

U.S. PATENT DOCUMENTS

| | | | |
|---|---|---|---|
| 2,273,416 | 2/1942 | Norwood | 273/165 |
| 2,877,465 | 3/1959 | Stroud | 2/161 A |
| 3,520,539 | 7/1970 | Haws | 273/166 |
| 3,541,990 | 3/1969 | DuMas | 441/69 |
| 3,554,554 | 2/1969 | Zane | 273/165 |
| 4,235,182 | 11/1980 | Bürger | 114/39 X |

FOREIGN PATENT DOCUMENTS

| | | | |
|---|---|---|---|
| 2535351 | 2/1977 | Fed. Rep. of Germany | 114/39 |

OTHER PUBLICATIONS

"Conway Lat Straps" Iron Man (Mag.) Jul. 1983, pp. 272–123.

*Primary Examiner*—Robert A. Hafer
*Assistant Examiner*—Chris Coppens
*Attorney, Agent, or Firm*—Ruth Moyerman

[57] ABSTRACT

A device to increase the user's gripping power and weight training level on isometric weight training equipment is disclosed. An inverted U-shaped cradle is placed over the bar of the weight equipment and the user's hand grips the outside surface of the grip. An endless belt attached to the bottom edge of the grip through a slot passes behind the user's wrist to provide reinforcement and increase the hand and finger's grip. The interior and exterior cradle surfaces may be covered with a friction enhancing material which also cushions the contact surfaces of the user's hands.

6 Claims, 4 Drawing Figures

WEIGHT LIFTING GRIPS

BACKGROUND OF THE INVENTION

1. Field of the Invention

This invention relates to user-manipulated weight exercising equipment, and more particularly to user-interface elements.

2. Description of the Prior Art

Many devices are known whose purpose is to function as gripping surfaces on weight exercising equipment. These devices range from knurling of the gripping surface to padding of the gripping surface. However, these devices do not aleviate the fatigue developed in the user's fingers and hands while manipulating the weight exercising equipment.

SUMMARY OF THE INVENTION

The aforementioned prior art problems are overcome by the weight lifting grips of this invention.

The instant weight lifting grips comprise, preferably a pair of, inverted U-shaped cradles which are preferably made of a strong material such as heavy guage sheet metal which resists deformation. The cradle is open at both ends and, in the preferred embodiment, has a slot on one side close to the outer edge. An endless belt of strong flexible material is slidably mounted through the slot and criss-crossed over to form a loop. The loop functions as a brace for the user's wrist and distributes the weight load across the user's hand and wrist.

The inside and outside cradle surfaces are preferably lined with a friction enhancing material which is soft enough to cushion the user's gripping surfaces and secure the grip to the weight equipment bar.

In use, the user's hand is inserted through the endless belt loop and encloses the grip from the unslotted side of the cradle. The unslotted side fits in the user's palm and the rest of the hand engages the grip with fingers on the same side as the slot. The endless belt loop encircles the backside of the wrist. Exertion of force on the grip to overcome the weight resistance results in distribution of the force along the entire hand and wrist, thereby reducing strain and fatigue on the fingers and increasing the weight load limit exercising level.

It is, therefore, an object of this invention to provide a weight exercising equipment grip which is easily adaptable to any weight exercising equipment with a bar type grip.

It is still another object of this invention to provide a weight exercising equipment grip which can be utilized by any exercising user irregardless of the user's hand size.

It is yet another object of this invention to increase the user weight load limit exercising level without overextending the capabilities of the user's hands.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
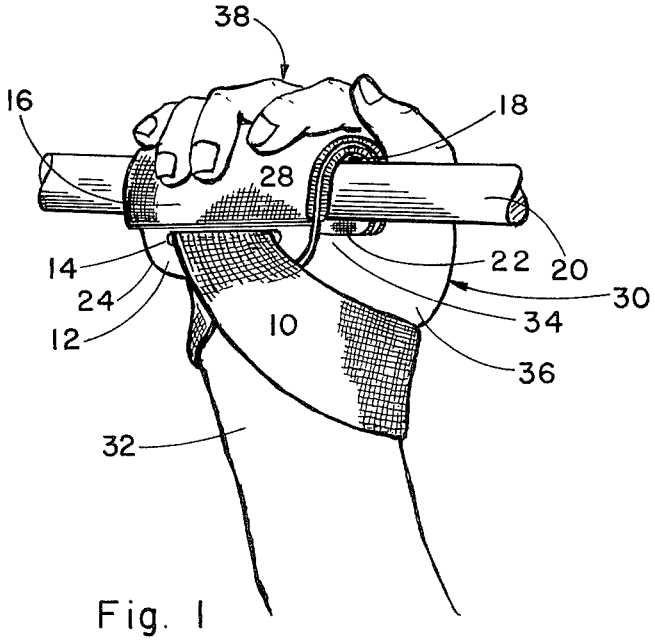
FIG. 1 depicts the device of this invention when worn and being used.

Referring now to FIG. 1, user's hand 30 is depicted gripping the device with belt 10 encircling user's wrist 32. Belt 10 is mounted on cradle 12 through slot 14. Belt 10 is twisted after passing through slot 14 to form an endless loop.

Exterior cradle surface 16 is shown covered with friction enhancing material 28, preferably a soft rubber material, which provides a secure gripping surface for user's hand 30. Interior cradle surface 18 is also covered with the same friction enhancing material 28 to provide secure engagement with weight equipment bar 20. Short side 22 of cradle 12 engages user's palm 34 while extended side 24 engages user's hand heel 36, thereby providing increased leverage to user's wrist 32. User's fingers 38 engage exterior surface 16.

Figure 2:
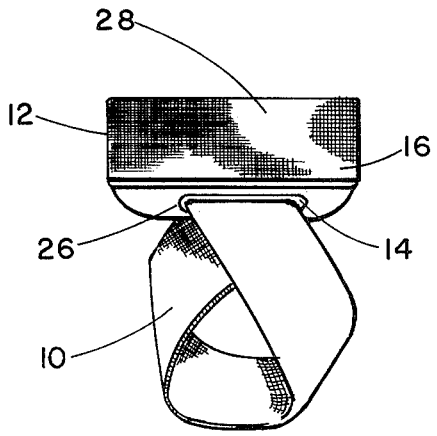
FIG. 2 is a full front view of the preferred embodiment showing the belt configuration.

FIG. 2 is a front view of the device showing cradle 12 having exterior surface 16 covered with a friction enhancing material 28. Belt 10 is slidably mounted to cradle 12 through slot 14 and forms a loop. Slot edge 26 is capped with a smooth surface to prevent premature wear of belt 10.

Figure 3:
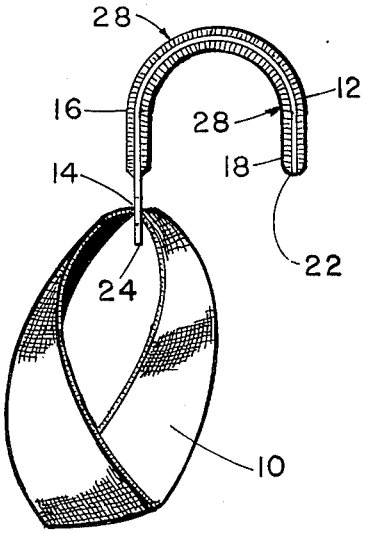
FIG. 3 is a side view of the grip and belt.

FIG. 3 shows a side view of cradle 12 having exterior cradle surface 16 and interior cradle surface 18 covered with a friction enhancing material 28. Belt 10 is shown slidably mounted through slot 14. Extended side 24 on which slot 14 is located, and short side 22, provide a configuration of cradle 12 which, in use, would fit user's hand 30 snuggly and provide maximum leverage by bracing a user's wrist with belt 10.

Figure 4:
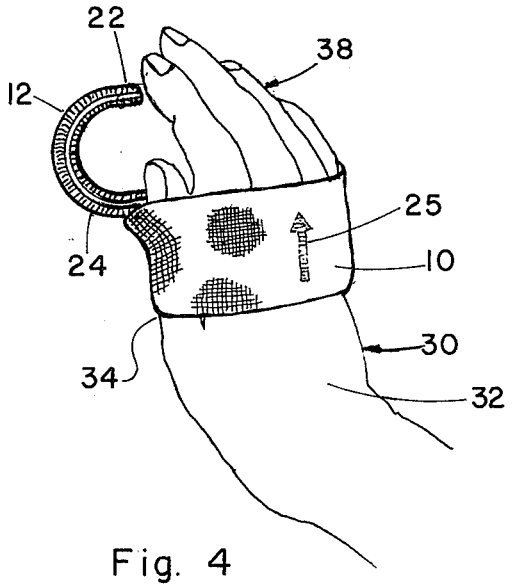
FIG. 4 illustrates a user placing the device into position on the hand.

FIG. 4 illustrates the device as it is being mounted in user's hand 30. User's hand 30 is being inserted upward through belt 10 (as indicated by arrow 25) and is shown with extended side 24 of cradle 12 on the outside of user's palm and and short side 22 engaging the user's fingers 38. In use, user's hand 30 would continue passing through belt 10 until belt 10 engages the back side of user's wrist 32 and short side 22 rests in user's palm 34.

There are many variations which may be practiced within the scope of this invention. Cradle 12 is preferably fabricated from heavy gauge sheet metal, but may be fabricated of any material which is strong enough to withstand the weight loads and resist deformation of cradle 12.

Friction enhancing material 28 is preferably rubber, but may be any suitable material which cushions the user's hand while increasing the user's gripping capabilities.

Belt 10 is preferably constructed from a woven canvas material but may be fabricated of any suitable material which is both resilient and flexible.

Having now illustrated and described my invention, it is not intended that such description limit this invention, but rather that this invention be limited only by reasonable interpretation of the apended claims.

What is claimed is:

1. A device for enhancing a user's grip on weight exercising equipment comprising:

(a) an inverted, generally U-shaped cradle with open ends, said cradle's sides having one outside edge extending beyond the outside edge of the opposite side and having a length generally equivalent to the width of the user's palm and a peripheral width generally equivalent to the length of the user's hand; and, (b) an endless belt having a halved band configuration attached to said cradle proximate said extended side outside edge, said belt having a perimeter predetermined to encircle a user's wrist with sufficient slack only to allow the user to grasp said cradle's exterior surface when said user's hand is inserted in said belt, whereby, in use, said cradle containing the bar of said exercise equipment is gripped by the user's hand so that said cradle opening rolls inward with said nonextended cradle side touching the user's palm and said belt braces and supports the user's wrist providing greatly increased lifting power to the user's hands while said cradle reduces strain on the user's hands.

2. The device according to claim 1 wherein said extended side has a slot proximate said outside edge midpoint through which said endless belt slidably passes.

3. The device according to claim 1 including, additionally, a friction enhancing material mounted on and coextensive with said cradle interior and exterior surfaces.

4. The device according to claim 2 wherein said slot is capped to provide a smooth surface to preclude premature fatigue and wear of said endless belt.

5. The device according to claim 1 wherein said endless belt comprises fabric formed by a half twist and wherein both ends are overlapped and joined together with stitching.

6. The device according to claim 1 wherein said belt includes directional indicia to aid the user in using said device.

* * * * *